US011299336B2

(12) United States Patent
Liao et al.

(10) Patent No.: US 11,299,336 B2
(45) Date of Patent: Apr. 12, 2022

(54) INFLATION BAG WITH PROTECTIVE BASE

(71) Applicant: KUNSHAN AIRBAG PACKING CORP, Kunshan (CN)

(72) Inventors: Kao-Hsiung Liao, Kunshan (CN); Ping-Yuan Liao, Kunshan (CN)

(73) Assignee: KUNSHAN AIRBAG PACKING CORP, Kunshan (CN)

( * ) Notice: Subject to any disclaimer, the term of this patent is extended or adjusted under 35 U.S.C. 154(b) by 149 days.

(21) Appl. No.: 16/796,096

(22) Filed: Feb. 20, 2020

(65) Prior Publication Data

US 2020/0270049 A1 Aug. 27, 2020

(30) Foreign Application Priority Data

Feb. 23, 2019 (TW) ..... 108106197

(51) Int. Cl.
*B65D 85/30* (2006.01)
*B65D 81/05* (2006.01)
*B65D 81/03* (2006.01)

(52) U.S. Cl.
CPC ..... *B65D 81/052* (2013.01); *B65D 81/03* (2013.01)

(58) Field of Classification Search
CPC ..... B65D 71/04; B65D 27/06; B65D 81/03; B65D 81/052; B65D 81/022; B65D 85/30
USPC ..... 383/84, 109; 206/522, 521
See application file for complete search history.

(56) References Cited

U.S. PATENT DOCUMENTS 6,629,777 B2 * 10/2003 Tanaka ..... B65D 81/052 383/3
7,066,331 B2 * 6/2006 Koyanagi ..... B65D 81/052 206/522
8,875,890 B2 * 11/2014 Liao ..... B65D 27/12 206/522

* cited by examiner

*Primary Examiner* — King M Chu
(74) *Attorney, Agent, or Firm* — Rabin & Berdo, P.C.

(57) ABSTRACT

An inflation bag with protective base is provided. Two outer films and two inner films are stacked with each other, and the stacked structure is heat sealed and inflated to form the inflation bag. The inflation bag includes two side surface walls and a bottom surface wall between the side surface walls and connected to bottoms of the side surface walls. The bottom surface wall includes bottom columns. Each bottom column has a first bottom column portion, a protection column portion, and a second column portion. A first heat-seal node is provided for attaching the outer films with the inner films, and the first bottom column portion is connected to the second bottom column portion. One or more second heat-seal nodes are provided on the protection column portion for attaching the outer films with the inner films, and the protection column portions are folded to form a protective base.

8 Claims, 6 Drawing Sheets

INFLATION BAG WITH PROTECTIVE BASE

CROSS-REFERENCE TO RELATED APPLICATION

This non-provisional application claims priority under 35 U.S.C. § 119(a) to Patent Application No. 108106197 filed in Taiwan, R.O.C. on Feb. 23, 2019, the entire contents of which are hereby incorporated by reference.

BACKGROUND

Technical Field

The instant disclosure relates to a cushioning inflation bag, in particular, to an inflation bag in which the bottom of the bag has a base providing protective and shockproof functions.

Related Art

Along with the developments of societies, logistics transportation becomes popular, and almost everything can be the objects for delivery. In nowadays society, not only the transportation of the objects are concerned to be achieved quickly, but also the protection ability for the packaging material for the objects is concerned. Regarding the delivery, during the transportation the packaging for the objects are expected to have shock absorption and anti-fall functions, and are expected to prevent the objects in the packaging from being directly damaged by external forces.

SUMMARY

Regarding transportation and packaging for large-sized objects or thinned-shape objects, the shock absorption and cushioning function for the packaging material are concerned. Specifically, since corners and edges of an object would be impacted easily by external forces during the transportation, damages of the objects occur on these portions easily if the packaging cannot provide sufficient shock absorption and cushioning function.

In view of these, one embodiment of the instant disclosure provides an inflation bag with protective base, where two outer films and two inner films in the outer films are stacked with each other to form a stacked structure, and the stacked structure is heat sealed and inflated to form the inflation bag. The inflation bag comprises two side surface walls and a bottom surface wall.

The side surface walls are opposite to each other, and each of the side surface walls comprises a plurality of sidewall columns. The bottom surface wall is located between the side surface walls and connected to bottoms of the side surface walls, and the bottom surface wall comprises a plurality of bottom columns Each of the bottom columns sequentially has a first bottom column portion, a protection column portion, and a second column portion. A first heat-seal node is provided for attaching the outer films with the inner films, so that the first bottom column portion is connected to the second bottom column portion. At least one second heat-seal node is provided on the protection column portion for attaching the outer films with the inner films, so that the protection column portions of the bottom columns are folded to form a protective base.

In one or some embodiments, a number of the at least one second heat-seal node is two. Each of the protection column portions sequentially has a first supporting portion, a connection portion, and a second supporting portion. The first supporting portion, the connection portion, and the second supporting portion of each of the protection column portions are enclosed to form a cushioning space. A cross section of the cushioning space is of an inversed triangular shape.

In one or some embodiments, a number of the at least one second heat-seal node is three. Each of the protection column portions sequentially has four supporting portions. The four supporting portions of each of the protection column portions are enclosed to form a cushioning space. A cross section of the cushioning space is of a rectangular shape.

In one or some embodiments, the inflation bag further comprises a connection component located above the protective base. The connection component is adapted to allow the connection between the side surface walls.

In one or some embodiments, the outer films and the inner films are attached with each other by heat-sealing, so that the side surface walls are connected with each other.

In one or some embodiments, the inflation bag further comprises a cushioning film located above the protective base. Two sides of the cushioning film are respectively connected to the side surface walls.

In one or some embodiments, the inflation bag further comprises a limiting gas bag located in a space formed by the side surface walls and the bottom surface wall. The limiting gas bag is located above the protective base. Two opposite sides of the limiting gas bag are respectively connected to side surface walls. The limiting gas bag comprises a plurality of limiting columns and a flat portion. At least one heat-seal node is provided on each of the limiting columns, and the limiting columns are folded to allow the flat portion to form a limiting space.

In one or some embodiments, the limiting columns are at two sides of the flat portion.

In one or some embodiments, after the limiting columns are folded, at least two of the limiting columns which are originally opposite to each other are connected with each other.

In one or some embodiments, the inflation bag further comprises a limiting gas bag located in a space formed by the side surface walls and the bottom surface wall. The limiting gas bag is located above the protective base. Two opposite sides of the limiting gas bag are respectively connected to side surface walls. The limiting gas bag comprises a plurality of limiting columns A plurality of heat-seal nodes is provided on the limiting columns, and the limiting columns are folded to form a limiting space.

According to one or some embodiments of the instant disclosure, during the transportation of the objects, if the objects falls off the ground unintentionally, the inflation bag provides at least two different ways for achieving cushioning and shockproof for the objects; that is, the cushioning and shockproof function provided by the protective base and the side surface walls. In some embodiments, the inflation bag further comprises the cushioning film or further comprises the limiting gas bag which is adjacent to the object to be delivered. Hence, another cushioning and shockproof function can be provided for the object; in other words, in these embodiment, the inflation bag provides at least three different ways for achieving cushioning and shockproof for the objects.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
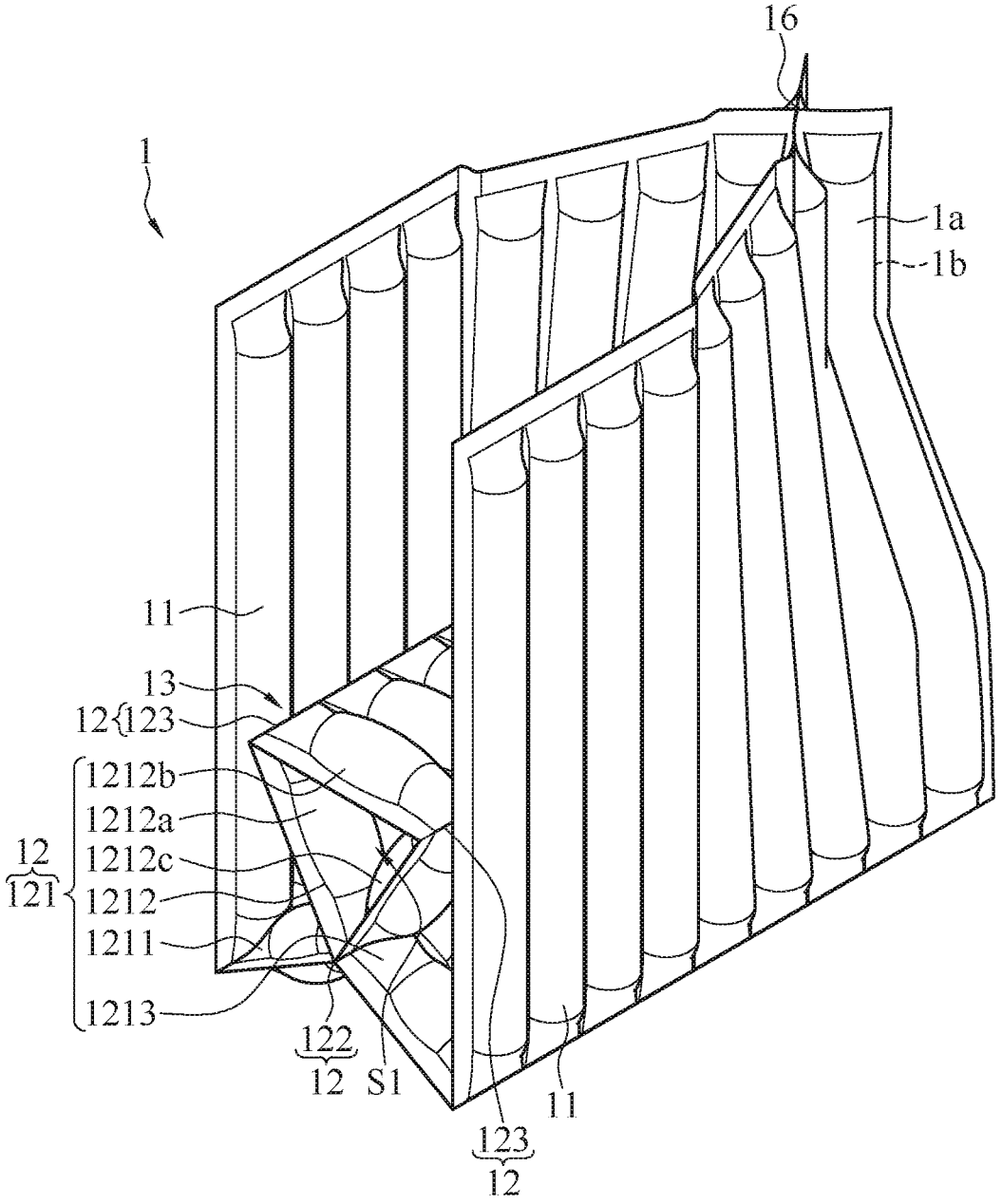
FIG. 1 illustrates a perspective view of an inflation bag with protective base according to a first embodiment of the instant disclosure.
Figure 2:
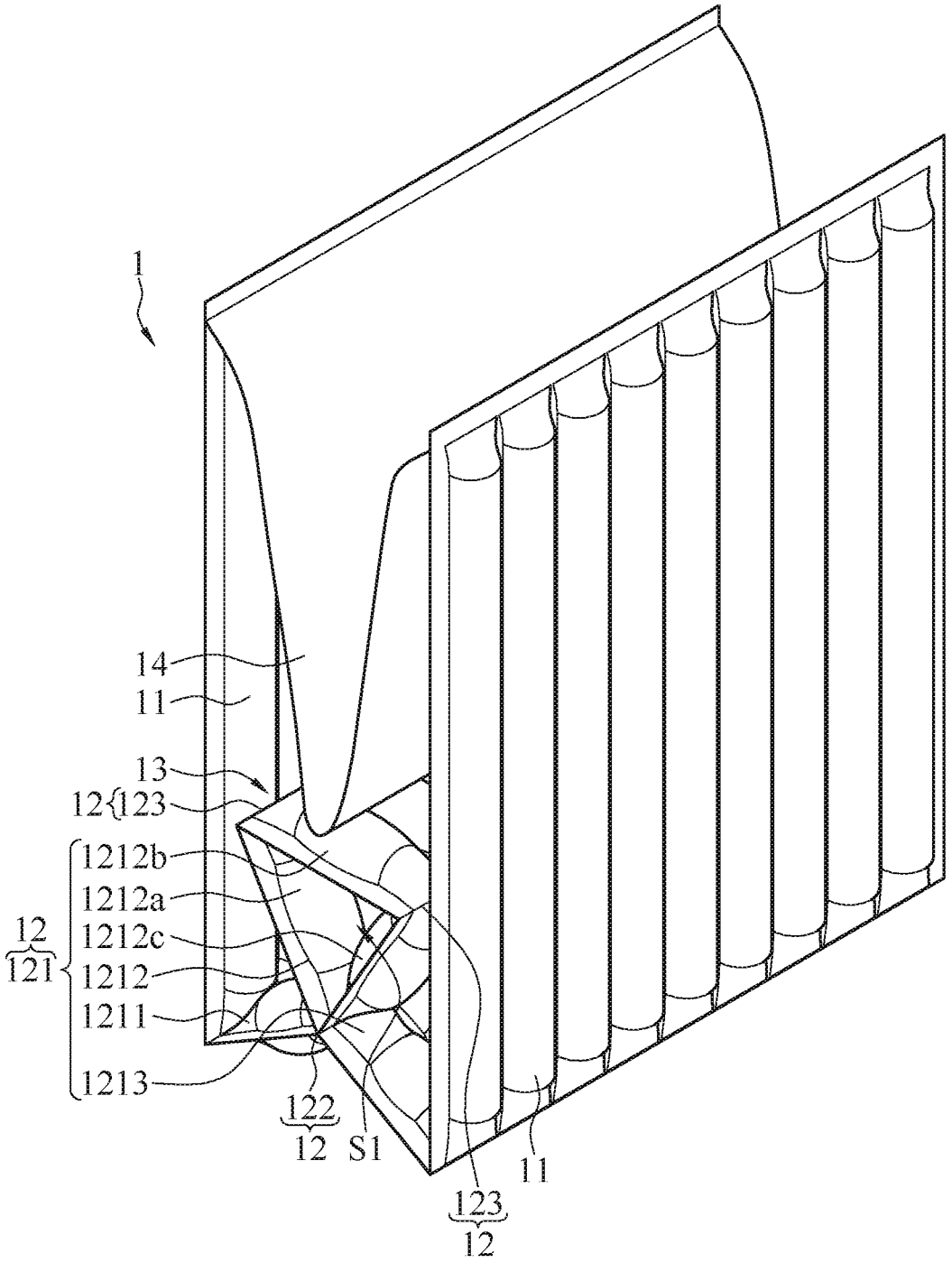
FIG. 2 illustrates a perspective view of an inflation bag with protective base according to a second embodiment of the instant disclosure.
Figure 3:
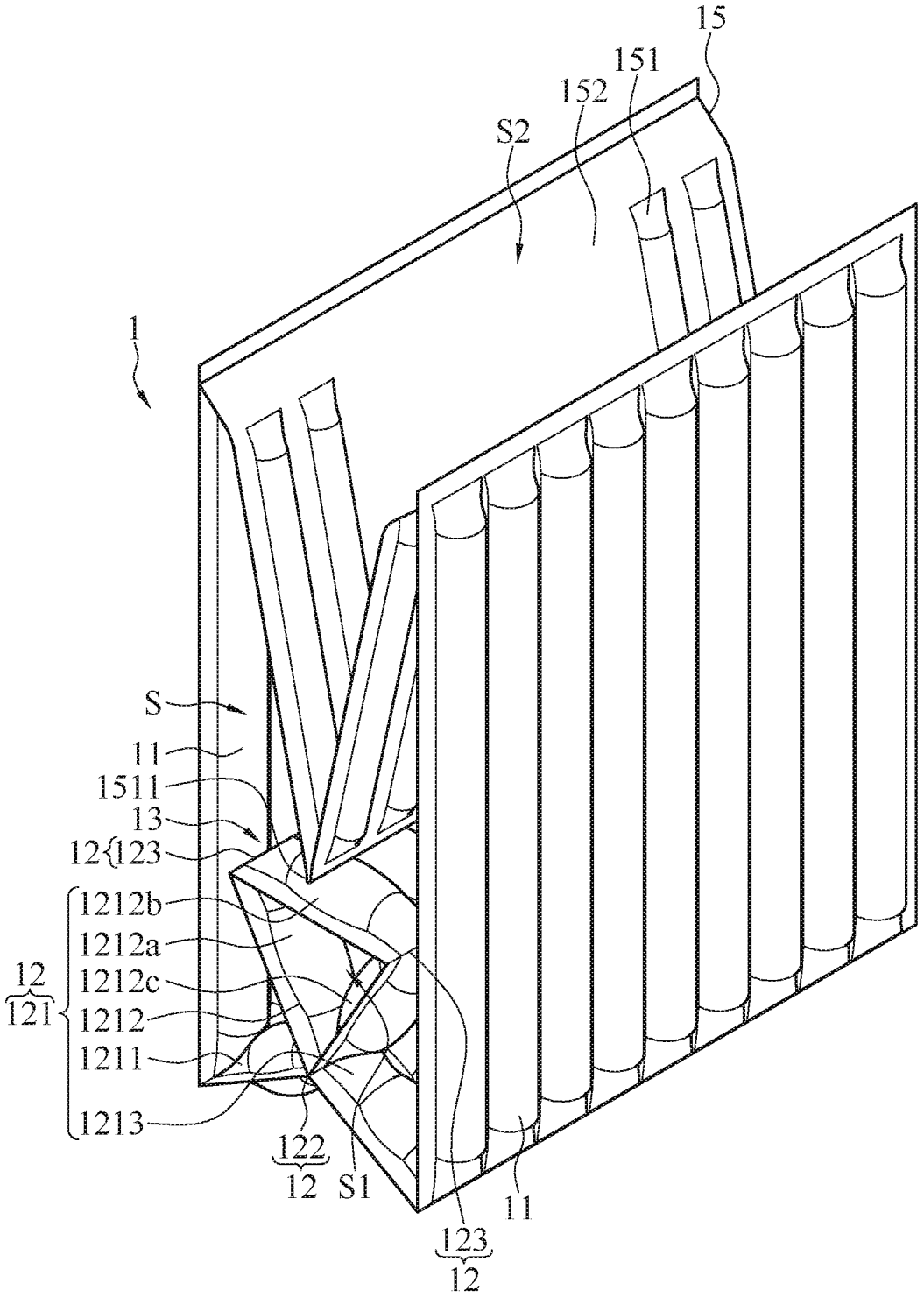
FIG. 3 illustrates a perspective view of an inflation bag with protective base according to a third embodiment of the instant disclosure.
Figure 4:
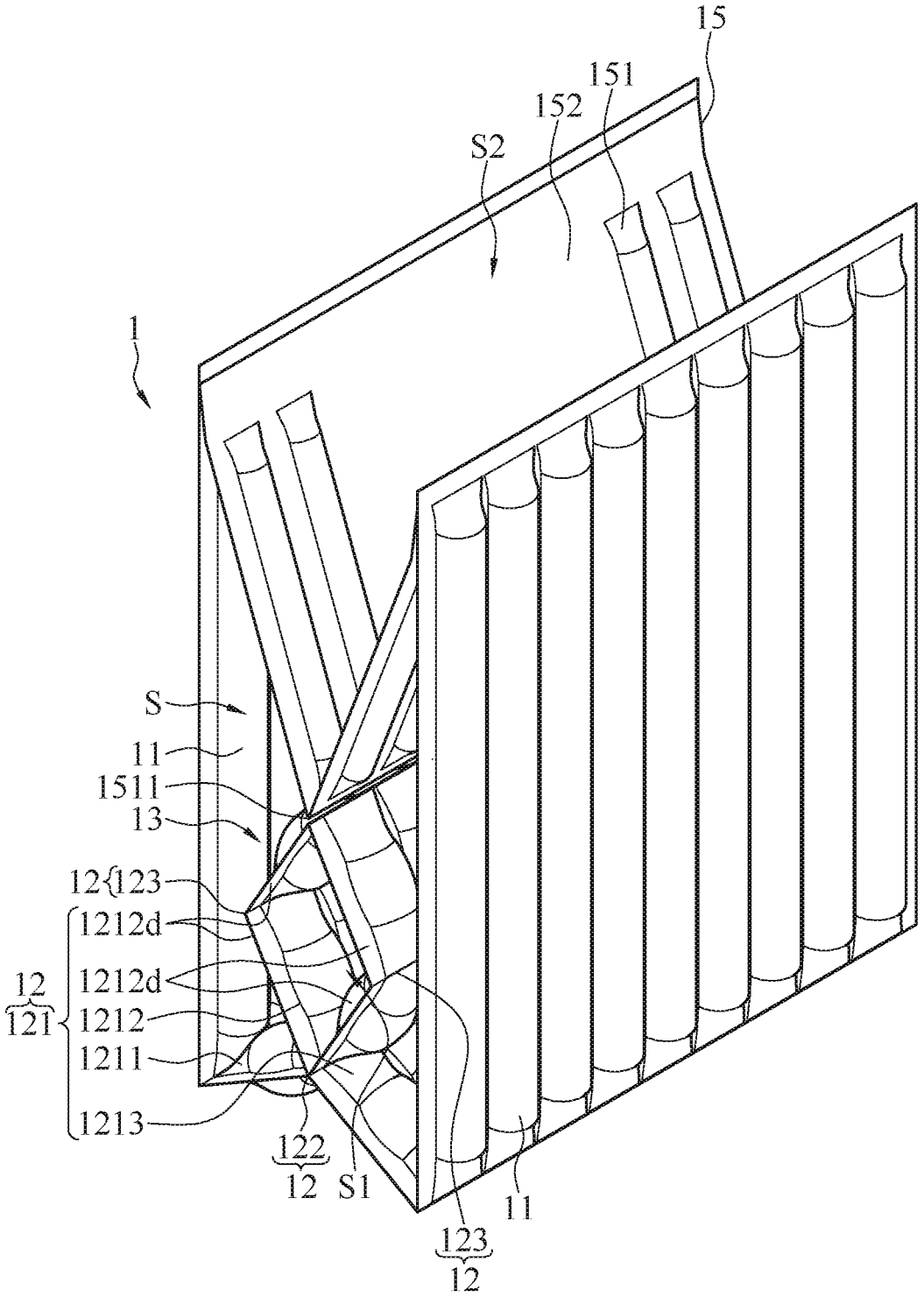
FIG. 4 illustrates a perspective view of an alternative embodiment of the inflation bag.

Please refer to FIGS. 1 to 3. FIG. 1 illustrates a perspective view of an inflation bag with protective base according to a first embodiment of the instant disclosure. FIG. 2 illustrates a perspective view of an inflation bag with protective base according to a second embodiment of the instant disclosure. FIG. 3 illustrates a perspective view of an inflation bag with protective base according to a third embodiment of the instant disclosure.

In one embodiment, two outer films 1*a* and two inner films 1*b* in the outer films are firstly stacked with each other to form a stacked structure, and then the heat-sealing techniques and inflation are applied to the stacked structure to form the inflation bag with protective base. As shown in FIG. 1, the inflation bag with protective case (hereinafter, the inflation bag 1) comprises two side surface walls 11 and a bottom surface wall 12.

The side surface walls 11 are opposite to each other. Each of the side surface walls 11 comprises a plurality of sidewall columns 111. The bottom surface wall 12 is located between the side surface walls 11 and connected to bottoms of the side surface walls 11. The bottom surface wall 12 comprises a plurality of bottom columns 121. Each of the bottom columns 121 sequentially has a first bottom column portion 1211, a protection column portion 1212, and a second bottom column portion 1213. A first heat-seal node 122 is provided for attaching the outer films with the inner films, so that the first bottom column portion 1211 is connected to the second bottom column portion 1213. At least one second heat-seal node 123 is provided on the protection column portion 1212 for attaching the outer films with the inner films, so that the protection column portions 1212 of the bottom columns 121 are folded to form a protective case 13. As compared with a gas bag known to the inventor(s) in which the base is manufactured by attaching two inner films with each other having insufficient structural strength and difficult and time-consuming manufacturing processes, the inflation bag 1 according to one or some embodiments of the instant disclosure has a greater structural strength, proper supporting ability, and reduced manufacturing processes.

In the embodiments shown in FIGS. 1 to 4, when the number of the second heat-seal node 123 is two, the protection column portion 1212 sequentially has a first supporting portion 1212*a*, a connection portion 1212*b*, and a second supporting portion 1212*c*. The first supporting portion 1212*a*, the connection portion 1212*b*, and the second supporting portion 1212*c* of each of the protection column portions 1212 are enclosed to form a cushioning space S1, and a cross section of the cushioning space S1 is of an inversed triangular shape. The connection portion 1212*b* is adapted to be abutted against the delivery object, thereby allowing the protective base 13 to perform the cushioning and shockproof function for the delivery object. However, it is understood that, the embodiments are provided for illustrative purposes, not limitations for the instant disclosure. In some embodiments, the number of the second heat-seal node 123 is three, and the protection column portion 1212 sequentially has four supporting portions 1212*d*, and the four supporting portions 1212*d* of each of the protection column portions 1212 are enclosed to form a cushioning space S1. In this embodiment, the cross section of the cushioning space S1 is of a rectangular shape (see FIG. 4), and the configuration of the inflation bag 1 also allows the protective base 13 to perform the cushioning and shockproof function for the delivery object.

Please refer to FIG. 1. In this embodiment, the inflation bag 1 further comprises a connection component 16 located above the protective base 13. The connection component 16 is adapted to allow the connection between the side surface walls 11. Accordingly, the inflation bag 1 can be fitted over corners or edges of the delivery object for protecting the corners or edges of the delivery object. The delivery object mays a large-sized panel, and the connection component 16 may be an adhesive glue or an adhesive tape. As shown in FIG. 1, in some embodiments, the outer films and the inner films are attached with each other by a heat-sealing line 16, so that the side surface walls 11 are connected with each other.

As shown in FIG. 2, in this embodiment, the inflation bag 1 further comprises a cushioning film 14 located above the protective base 13. Two sides of the cushioning film 14 are respectively connected to the side surface walls 11. The cushioning film 14 can be fitted over the delivery object as a primary protection package. In some embodiments, opposite portions at one side of the cushioning films 14 are attached with each other. Hence, the inflation bag 1 can be fitted over the corners or edges of the delivery object.

As shown in FIG. 3, in this embodiment, the inflation bag 1 further comprises a limiting gas bag 15. The limiting gas bag 15 is located in a space S formed by the side surface walls 11 and the bottom surface wall 12, and the limiting gas bag 15 is located above the protective base 13. Two opposite sides of the limiting gas bag 15 are respectively connected to the side surface walls 11. The limiting gas bag 15 comprises a plurality of limiting columns 151 and a flat portion 152. At least one heat-seal node 1511 is provided on each of the limiting columns 151, and the limiting columns 151 are folded to allow the flat portion 152 to form a limiting space S2. In the embodiment shown in FIG. 3, the limiting columns 151 are at two sides of the flat portion 152.

Figure 5:
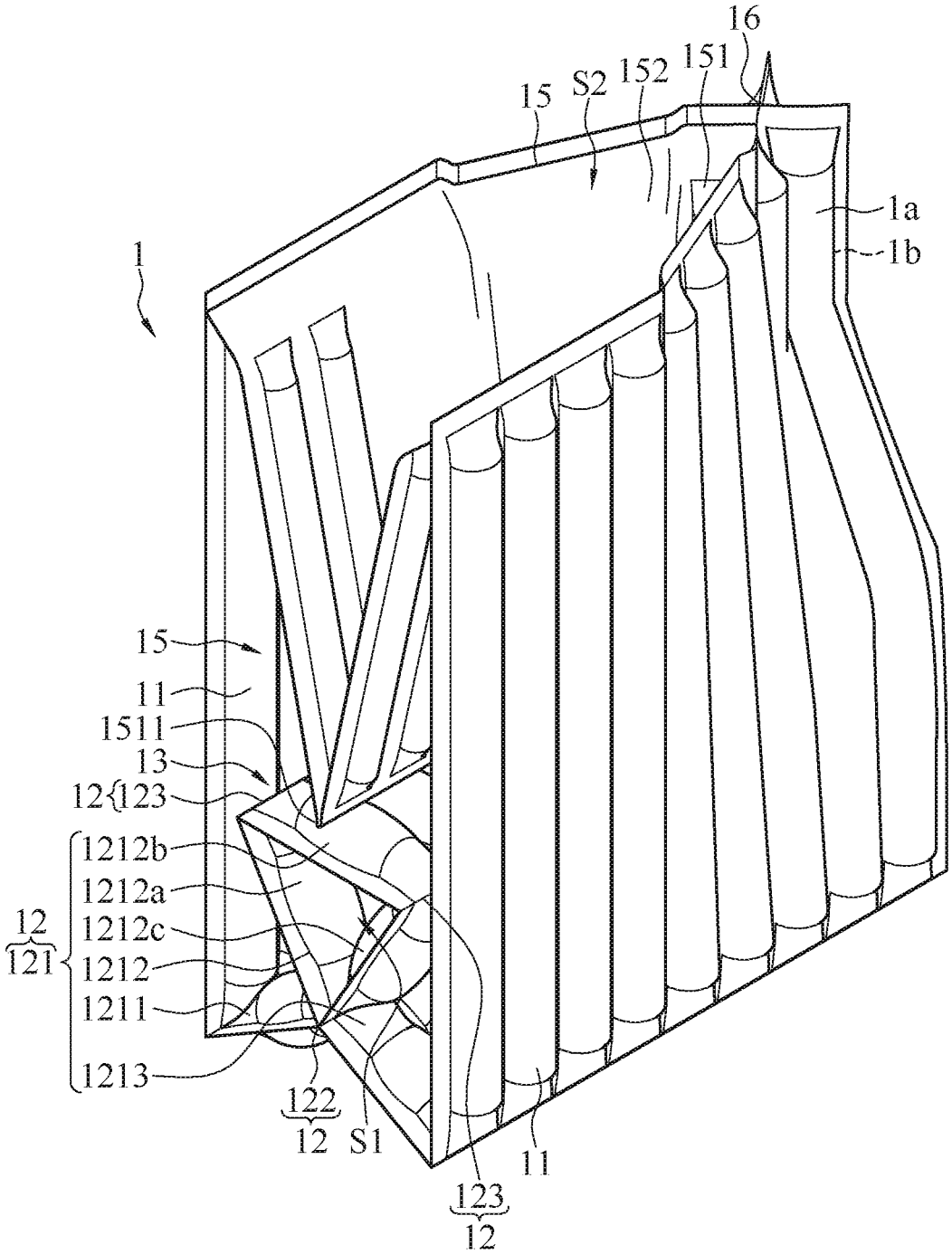
FIG. 5 illustrates a perspective view of another alternative embodiment of the inflation bag.

In other words, in this embodiment, the flat portion 152 can be adapted to fit over the delivery object. Moreover, because the limiting columns 151 have bulkier sizes than the flat portion 152, the delivery object can be limited within the limiting space S2. Please refer to FIG. 5. In some embodiments, after the limiting columns 151 are folded, at least two of the limiting columns 151 which are originally opposite to each other are connected with each other. Accordingly, the delivery object can be properly limited within the limiting space S2, thereby achieving the protection for the delivery object.

Figure 6:
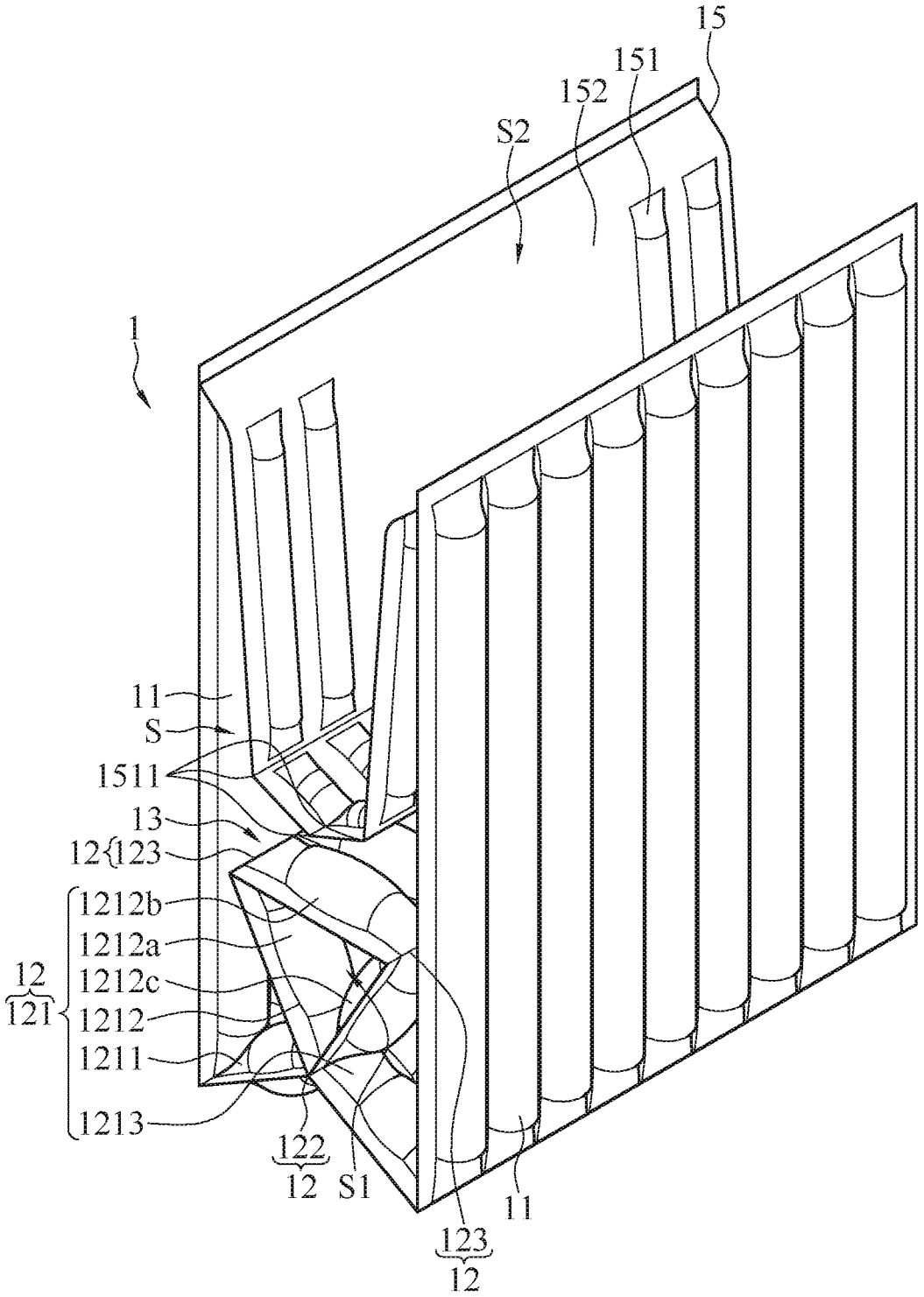
FIG. 6 illustrates a perspective view of yet another alternative embodiment of the inflation bag.

Please refer to FIG. 6. In some embodiments, the limiting gas bag 15 is formed by a plurality of limiting columns 151. A plurality of heat-seal nodes 1511 is provided on the limiting columns 151, and the limiting columns 151 are folded to form the limiting space.

According to one or some embodiments of the instant disclosure, during the transportation of the objects, if the objects falls off the ground unintentionally, the inflation bag provides at least two different ways for achieving cushioning and shockproof for the objects; that is, the cushioning and shockproof function provided by the protective base and the side surface walls. In some embodiments, the inflation bag further comprises the cushioning film or further comprises the limiting gas bag which is adjacent to the object to be delivered. Hence, another cushioning and shockproof function can be provided for the object; in other words, in these embodiment, the inflation bag provides at least three different ways for achieving cushioning and shockproof for the objects.

Moreover, as compared with a gas bag known to the inventor(s) in which the base is manufactured by attaching two inner films with each other having insufficient structural strength and difficult and time-consuming manufacturing processes, the inflation bag according to one or some embodiments of the instant disclosure has a greater structural strength, proper supporting ability, and reduced manufacturing processes. Therefore, the aforementioned problem(s) can be improved.

What is claimed is:

1. An inflation bag with protective base, wherein two outer films and two inner films in the outer films are stacked with each other to form a stacked structure, and the stacked structure is heat sealed and inflated to form the inflation bag, the inflation bag comprises:

two side surface walls opposite to each other, wherein each of the side surface walls comprises a plurality of sidewall columns; and a bottom surface wall located between the side surface walls and connected to bottoms of the side surface walls, wherein the bottom surface wall comprises a plurality of bottom columns, and each of the bottom columns sequentially has a first bottom column portion, a protection column portion, and a second bottom column portion; a first heat-seal node is provided for attaching the outer films with the inner films, so that the first bottom column portion is connected to the second bottom column portion; at least one second heat-seal node is provided on the protection column portion for attaching the outer films with the inner films, so that the protection column portions of the bottom columns are folded to form a protective base wherein a number of the at least one second heat-seal node is two, each of the protection column portions sequentially has a first supporting portion, a connection portion, and a second supporting portion, the first supporting portion, the connection portion, and the second supporting portion of each of the protection column portions are enclosed to form a cushioning space, and a cross section of the cushioning space is of an inversed triangular shape.

2. An inflation bag with protective base, wherein two outer films and two inner films in the outer films are stacked with each other to form a stacked structure, and the stacked structure is heat sealed and inflated to form the inflation bag, the inflation bag comprises:

two side surface walls opposite to each other, wherein each of the side surface walls comprises a plurality of sidewall columns; and a bottom surface wall located between the side surface walls and connected to bottoms of the side surface walls, wherein the bottom surface wall comprises a plurality of bottom columns, and each of the bottom columns sequentially has a first bottom column portion, a protection column portion, and a second bottom column portion; a first heat-seal node is provided for attaching the outer films with the inner films, so that the first bottom column portion is connected to the second bottom column portion; at least one second heat-seal node is provided on the protection column portion for attaching the outer films with the inner films, so that the protection column portions of the bottom columns are folded to form a protective base, wherein a number of the at least one second heat-seal node is three, each of the protection column portions sequentially has four supporting portions, and the four supporting portions of each of the protection column portions are enclosed to form a cushioning space, and a cross section of the cushioning space is of a rectangular shape.

3. The inflation bag according to claim 1, wherein the outer films and the inner films are attached with each other by heat-sealing, so that the side surface walls are connected with each other.

4. The inflation bag according to claim 1, further comprising a cushioning film located above the protective base, wherein two sides of the cushioning film are respectively connected to the side surface walls.

5. The inflation bag according to claim 1, further comprising a limiting gas bag located in a space formed by the side surface walls and the bottom surface wall, wherein the limiting gas bag is located above the protective base, and two opposite sides of the limiting gas bag are respectively connected to the side surface walls; the limiting gas bag comprises a plurality of limiting columns and a flat portion, at least one heat-seal node is provided on each of the limiting columns, and the limiting columns are folded to allow the flat portion to form a limiting space.

6. The inflation bag according to claim 5, wherein the limiting columns are at two sides of the flat portion.

7. The inflation bag according to claim 5, wherein after the limiting columns are folded, at least two of the limiting columns which are originally opposite to each other are connected with each other.

8. The inflation bag according to claim 1, further comprising a limiting gas bag located in a space formed by the side surface walls and the bottom surface wall, wherein the limiting gas bag is located above the protective base, and two opposite sides of the limiting gas bag are respectively connected to the side surface walls; the limiting gas bag comprises a plurality of limiting columns, a plurality of heat-seal nodes is provided on the limiting columns, and the limiting columns are folded to form a limiting space.

* * * * *